US005439769A

United States Patent [19]

Kunugi

[11] Patent Number: 5,439,769

[45] Date of Patent: Aug. 8, 1995

[54] DEVELOPING METHOD AND SYSTEM

[75] Inventor: Masanao Kunugi, Nagano, Japan

[73] Assignee: Seiko Epson Corporation, Tokyo, Japan

[21] Appl. No.: 166,017

[22] Filed: Dec. 14, 1993

[30] Foreign Application Priority Data

Dec. 16, 1992 [JP] Japan ..... 4-336384
Oct. 21, 1993 [JP] Japan ..... 5-263893

[51] Int. Cl.[6] ..... G03G 13/08

[52] U.S. Cl. ..... 430/102; 430/100; 430/101

[58] Field of Search ..... 430/100, 101, 102

[56] References Cited

U.S. PATENT DOCUMENTS 2,297,691 10/1942 Carlson ..... 430/31
4,518,673 5/1985 Noguchi et al. ..... 430/108
4,590,140 5/1986 Mitsuhashi et al. ..... 430/102
4,943,504 7/1990 Tomura et al. ..... 430/102
4,980,256 12/1990 Kato et al. ..... 430/106.6

FOREIGN PATENT DOCUMENTS 0098112 6/1983 European Pat. Off. .
0241160 3/1987 European Pat. Off. .
51-36070 10/1976 Japan .
52-36414 9/1977 Japan .
54-16219 6/1979 Japan .
55-18656 2/1980 Japan .
55-79454 6/1980 Japan .
55-159450 12/1980 Japan .
57-114163 7/1982 Japan .
60-45272 3/1985 Japan .
61-239272 10/1986 Japan .
61-277964 12/1986 Japan .
62-55146 11/1987 Japan .
63-62740 12/1988 Japan .
46953 2/1992 Japan .
4145448 5/1992 Japan .
2258053 7/1992 United Kingdom .

*Primary Examiner*—Roland Martin
*Attorney, Agent, or Firm*—Sughrue, Mion, Zinn, Macpeak & Seas

[57] ABSTRACT

A developing method using negative toner, constituted by a toner carrier 1 and toner so that triboelectric series of the toner carrier 1, a toner base particle 3 and a surface additives 2 have a relationship in which the toner carrier 1, the surface additives 2 and the toner base particle 3 are arranged in this order from the plus side.

50 Claims, 13 Drawing Sheets

FIG. 8

PLUS SIDE

- TONER CARRIER E (BASE MATERIAL: EPDM, SURFACE: NYLON)
- TONER CARRIER D (BASE MATERIAL: EPDM, SURFACE: NICKEL ELECTRO-CAST TUBE)
- TONER CARRIER B (NBR)
- TONER CARRIER A (URETHANE RUBBER)
- TONER CARRIER C (BASE MATERIAL: EPDM, SURFACE: URETHANE RESIN)
- METAL BLADE MADE OF STAINLESS STEEL
- URETHANE SPONGE ROLLER
- OUTER ADDITION AGENT a
- TONER BASE PARTICLE A

MINUS SIDE

FIG. 9

PLUS SIDE

- OUTER ADDITION AGENT b
- TONER CARRIER B (NBR)
- TONER CARRIER A (URETHANE RUBBER)
- TONER CARRIER C (BASE MATERIAL: EPDM, SURFACE URETHANE RESIN)
- METAL BLADE MADE OF STAINLESS STEEL
- URETHANE SPONGE ROLLER
- TONER BASE PARTICLE A

MINUS SIDE

FIG. 10

PLUS SIDE
- TONER CARRIER E (BASE MATERIAL: SILICONE, SURFACE: NYLON RESIN)
- METAL BLADE MADE OF STAINLESS STEEL
- URETHANE SPONGE ROLLER
- TONER BASE PARTICLE A
- OUTER ADDITION AGENT c

MINUS SIDE

FIG. 11

PLUS SIDE
- TONER CARRIER D (BASE MATERIAL: EPDM, SURFACE: NICKEL ELECTRO-CAST TUBE)
- TONER CARRIER B (NBR)
- TONER CARRIER A (URETHANE RUBBER)
- TONER CARRIER C (BASE MATERIAL: EPDM, SURFACE: URETHANE RESIN)
- METAL BLADE MADE OF STAINLESS STEEL
- URETHANE SPONGE ROLLER
- TONER BASE PARTICLE A
- OUTER ADDITION AGENT c

MINUS SIDE

FIG. 12

PLUS SIDE
- METAL BLADE MADE OF STAINLESS STEEL
- URETHANE SPONGE ROLLER
- TONER BASE PARTICLE A
- TONER CARRIER F (BASE MATERIAL: SILICONE, SURFACE: FLUORORESIN)
- OUTER ADDITION AGENT c

MINUS SIDE

FIG. 14

PLUS SIDE
- TONER BASE PARTICLE B
- OUTER ADDITION AGENT b
- METAL BLADE MADE OF STAINLESS STEEL
- URETHANE SPONGE ROLLER
- TONER CARRIER G (EPDM)
- TONER CARRIER H (SILICONE)

MINUS SIDE

FIG. 15

PLUS SIDE
- TONER BASE PARTICLE B
- METAL BLADE MADE OF STAINLESS STEEL
- URETHANE SPONGE ROLLER
- TONER CARRIER G (EPDM)
- TONER CARRIER H (SILICONE)
- OUTER ADDITION AGENT c

MINUS SIDE

FIG. 16

PLUS SIDE
- OUTER ADDITION AGENT d
- TONER BASE PARTICLE B
- METAL BLADE MADE OF STAINLESS STEEL
- URETHANE SPONGE ROLLER
- TONER CARRIER F (BASE MATERIAL: SILICONE, SURFACE: FLUORORESIN)

MINUS SIDE

DEVELOPING METHOD AND SYSTEM

BACKGROUND OF THE INVENTION

1. Field of the Invention

The present invention relates to a development system constituted by toner, a toner carrier, a toner supply member and a toner layer thickness regulating member. More particularly, it relates to the relationship in the order between respective triboelectric series a toner carrier, a toner base particle and a surface additives.

2. Conventional Art

As electronic photography, heretofore, a large number of methods based on the Carlson's process disclosed in U.S. Pat. No. 2,297,691 have been proposed. In general, an electrostatic latent image is formed on a photosensitive material using a photoconductive substance. Then, fine powder called "toner" is selectively deposited on the latent image to perform development to thereby make the latent image visible. After toner for making the latent image visible is transferred to a transfer material such as paper or the like as occasion demands, the toner is fixed by heat and pressure or by solvent vapor to thus obtain a matter on which an image is formed.

Development methods of making the electrostatic latent image on the photosensitive material visible are roughly classified into dry developing methods and liquid developing methods. Among the dry developing methods, a magnetic brush developing method, a cascade developing method and so on are known as a two-component developing method using a carrier. Further, a jumping developing method, a FEED developing method, a magnetic brush developing method and so on are known as a one-component developing method. As toner for making the electrostatic latent image visible, negative toner or positive toner is used. As a development system, positive development and reversal development are used.

Particularly as a developing method in which toner is formed as a thin layer on a toner carrier by a regulating member, and the toner is conveyed to a latent image carrier to thereby make a latent image visible, various kinds of methods have been disclosed in Japanese Patent Postexamination Publication No. Sho-52-36414, Japanese Patent Unexamined Publication Nos. Sho-57-114163, Sho-54-43027 and Sho-55-18656, and so on. In these aforementioned developing methods, carrier particles as used in the two-component developing method are not used, so that electric charges must be given to toner efficiently by a toner carrier, a toner layer (thickness) regulating member and a supply member.

To solve this problem, heretofore, various proposals have been made. For example, in Japanese Patent Postexamination Publication No. Sho-51-36070, a doctor blade disposed far from toner with respect to triboelectric series is used. In Japanese Patent Postexamination Publication No. Hei-4-6953, a material of a non-magnetic sleeve disposed far from the triboelectric series of toner. In Japanese Patent Unexamined Publication No. Sho-60-45272, an electrification member provided under the consideration of a triboelectric series caused by friction against a developer is applied onto a carrier surface and a layer-regulating member.

In Japanese Patent Unexamined Publication No. Sho-61-39272, there is a proposal in which a fluidization assistant being enough near but free from triboelectric charge in the point of view of triboelectric series of the toner layer (thickness) regulating member is used. With respect to a surface additives provided in the surface portion of toner, use of silica is popularized to give fluidity to toner to thereby form a high-quality image. With respect to the surface additives, however, various proposals for improvement have been made. For example, in Japanese Patent Postexamination Publication No. Sho-54-16219, Japanese Patent Unexamined Publication Nos. Sho-55-159450 and Sho-61-277964 and so on, minus-charge toner obtained by hydrophobing silica with dimethyldichlorsilane, hexamethyldisilane and silicone oil is disclosed.

Further, in Japanese Patent Unexamined Publication No. Sho. 55-79454, a developing agent having a surface treated with organic acid having carbon fluoride groups in order to change the triboelectric series thereof to thereby prevent filming is disclosed. Further, in Japanese Patent Postexamination Publication Nos. Sho. 63-62740 and Hei. 4-145448, toner in which the state of deposition of the surface additives is limited is disclosed. There is however no improvement but an improvement in the relationship between the triboelectric series of toner carrier and toner, an improvement in surface treatment of the surface additives, and the like. Even in the case where the aforementioned methods are used, there arises a problem in that it is difficult to reduce deposition of toner onto a non-image portion, that is, it is difficult to reduce fogging in the ground. Further, the aforementioned methods are weak against the change of time and the change of environment. There arises a problem in that it is difficult to provide stably a high-quality image free from fogging in the ground. Causes of such problems, however, have been not made clear yet.

SUMMARY OF THE INVENTION

As a result of eager investigation to solve the aforementioned problems, according to the present invention, it has been found that fogging and triboelectric series have a large correlation.

It is therefore an object of the present invention to provide a developing method in which deposition of toner onto a non-image portion is avoided, that is, fogging is avoided. It is another object of the present invention to provide a developing method which is excellent in durability so that image deterioration such as fogging is avoided in long-term continuous use.

It is another object of the present invention to provide high-quality images stably for a long term even under the environment of a high temperature and a high humidity and under the environment of a low temperature and a low humidity.

According to the present invention, there is provided a developing method of the type in which negative toner constituted by a toner base particle and a surface additives is transferred to a latent image carrier by using a toner carrier to make an electrostatic latent image on the latent image carrier visible, characterized in that:

(1) respective triboelectric series of the toner carrier, the toner base particle and the surface additives have a relationship in which the toner carrier, the surface additives and the toner base particle are arranged in this order from the plus side;

(2) respective triboelectric series of the toner carrier, the toner base particle and the surface additives have a relationship in which the toner carrier, the toner base particle and the surface additives are arranged in this order from the plus side; or (3) respective triboelectric series of the toner carrier, the toner base particle and the surface additives have a relationship in which the toner base particle, the toner carrier and the surface additives are arranged in this order from the plus side.

According to the other invention which relates to positive toner having reverse polarity to the aforementioned present invention, there is provided a developing method of the type in which positive toner constituted by a toner base particle and a surface additives is transferred to a latent image carrier by using a toner carrier to make an electrostatic latent image on the latent image carrier visible, characterized in that:

(4) respective triboelectric series of the toner carrier, the toner base particle and the surface additives have a relationship in which the toner carrier, the surface additives and the toner base particle are arranged in this order from the minus side;

(5) respective triboelectric series of the toner carrier, the toner base particle arid the surface additives have a relationship in which the toner carrier, the toner base particle and the surface additives are arranged in this order from the minus side; or (6) respective triboelectric series of the toner carrier, the toner base particle and the surface additives have a relationship in which the toner base particle, the toner carrier and the surface additives are arranged in this order from the minus side.

BRIEF DESCRIPTION OF THE DRAWINGS

FIG. 8 is a view showing a relationship between the triboelectric series of the members used in Experimental Example 1 according to the present invention;

FIG. 9 is a view showing a relationship between the triboelectric series of the members used in Comparative Example 1 with respect to the present invention;

FIG. 10 is a view showing a relationship between the triboelectric series of the members used in Experimental Example 3 according to the present invention;

FIG. 11 is a view showing a relationship between the triboelectric series of the members used in Comparative Example 2 with respect to the present invention;

FIG. 12 is a view showing a relationship between the triboelectric series of the members used in Experimental Example 5 according to the present invention;

FIG. 14 is a view showing a relationship between the triboelectric series of the members used in Experimental Example 6 according to the present invention;

FIG. 15 is a view showing a relationship between the triboelectric series of the members used in Comparative Example 3 with respect to the present invention;

FIG. 16 is a view showing a relationship between the triboelectric series of the members used in Experimental Example 8 according to the present invention;

DESCRIPTION OF THE PREFERRED EMBODIMENTS

The present invention will be described below in detail on the basis of embodiments. The present invention will be described with reference to the drawings. "Negative toner" according to the present invention means toner which is such that toner on a toner carrier is transferred to an area for making an electrostatic latent image on a latent image carrier visible (hereinafter referred to as "image portion") to thereby make the electrostatic latent image visible when the direction of electric field between the latent image carrier image portion and the toner carrier changes from the latent image carrier to the toner carrier. In the following, the case of use of negative toner will be described.

Figure 1A:
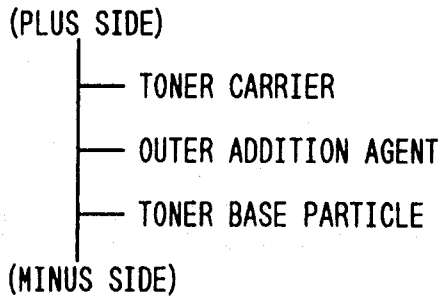
FIG. 1A is a view showing first relationship between triboelectric series of a toner carrier, a surface additives and a toner base particle used in a developing method using negative toner according to the present invention.

FIG. 1A shows a first triboelectric series relationship according to the present invention. FIG. 1A and FIG. 1C typically show the relationship of the charge polarity between a toner carrier 1, a surface additives 2 and a toner base particle 3 in a development apparatus.

Figure 1B:
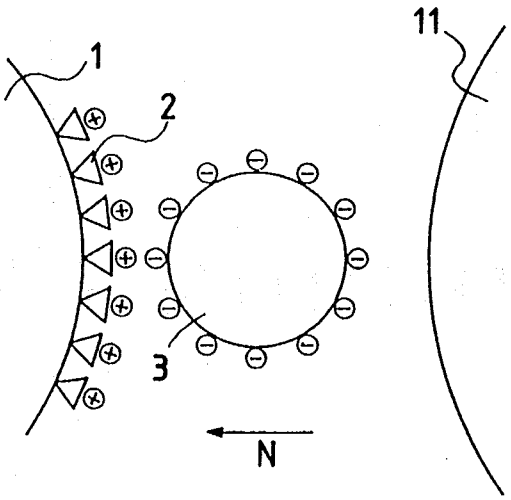
FIG. 1B is a view showing the charge polarity in the case where the surface additives is not deposited on a surface of the toner carrier.
Figure 1C:
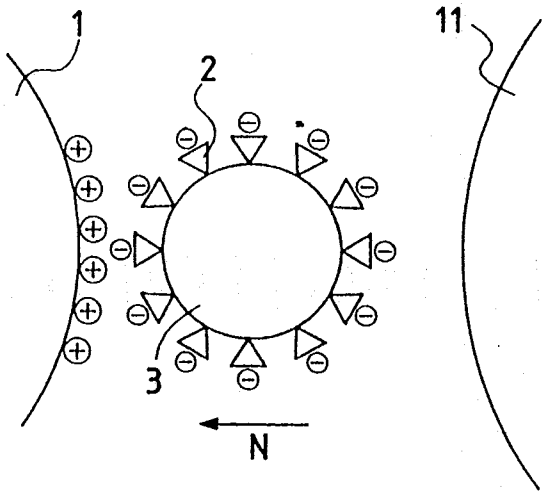
FIG. 1C is a view showing the charge polarity in the case where the surface additives is deposited on a surface of the toner carrier.

In the case where the surface additives 2 is departed from the toner base particle 3 and deposited on a surface of the toner carrier 1 as shown in FIG. 1B, the toner base particle 3 comes into contact with the surface additives 2 on the surface of the toner carrier 1 and is charged to minus on the basis of the relationship in FIG. 1A so that the toner base particle 3 is moved to the image portion on the latent image carrier 11 by electric field N so as to be used in order to make the latent image visible. Reversely, the surface additives 2 on the surface of the toner carrier 1 is charged to plus. Accordingly, the toner base particle 3 is prevented from being charged to plus as a cause of fogging in the ground, so that it is used as negative toner for making the latent image on the latent image carrier 11 visible.

On the other hand, in the case where the surface additives 2 is not deposited on the toner carrier 1 as shown in FIG. 1C, the surface additives 2 and the toner base particle 3 being in contact with the toner carrier 1 are charged to minus in connection with FIG. 1A, so that they are used in order to make the latent image on the latent image carrier 11 visible in the same manner as in FIG. 1B. As described above, by arranging the respective members so that the relationship of order of the triboelectric series of the toner carrier 1, the toner base particle 3 and the surface additives 2 is as shown in FIG. 1A, no plus-charged toner base particle 3 is generated regardless of the presence or absence of the surface additives deposited on the surface of the toner carrier 1. Accordingly, unnecessary toner can be prevented from being deposited on a non-image portion, that is, fogging in the ground can be eliminated.

In the following, a second triboelectric series relationship according to the present invention will be described.

Figure 2A:
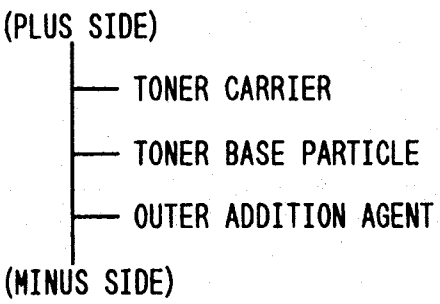
FIG. 2A is a view showing a second relationship between triboelectric series of a toner carrier, a surface additives and a toner base particle used in a developing method using negative toner according to the present invention.
Figure 2B:
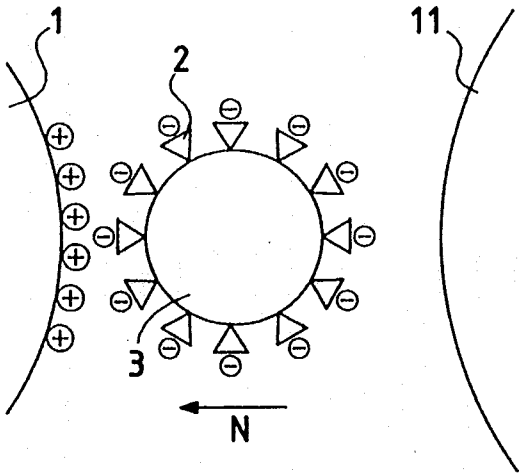
FIG. 2B is a view showing the charge polarity in the case where the surface additives is not deposited on a surface of the toner carrier.
Figure 2C:
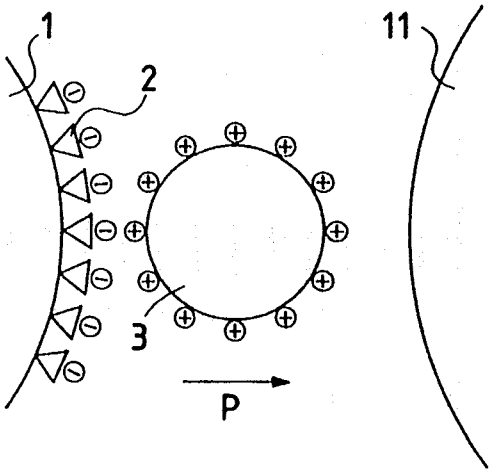
FIG. 2C is a view showing the charge polarity in the case where the surface additives is deposited on a surface of the toner carrier, for comparison with FIG. 2B.

FIG. 2A shows the second triboelectric series relationship. FIG. 2B typically shows the charge polarity relationship between the toner carrier 1, the surface additives 2 and the toner base particle 3 in a development apparatus. FIG. 2C typically shows a comparative example for explaining FIG. 2B. In this occasion, when the surface additives 2 is not deposited on the toner carrier 1 as shown in FIG. 2B, the surface additives 2 and the toner base particle 3 being in contact with the toner carrier 1 are charged to minus on the basis of the relationship in FIG. 2A and moved to the image portion on the latent image carrier 11 by electric field N so that they are used in order to make the latent image visible. Accordingly, production of plus-charged toner base particles 3 can be prevented, that is, fogging in the ground can be eliminated.

On the other hand, when the surface additives 2 is deposited on the toner carrier 1 as shown in FIG. 2C, the toner base particle 3 being in contact with the surface additives 2 is charged to plus and moved to the non-image portion on the latent image carrier 11 by electric field P in the non-image portion. As a result, fogging in the ground occurs. Accordingly, in the second triboelectric series relationship according to the present invention, it is preferable that the surface additives 2 is not deposited on the toner carrier 1.

In the following, a third triboelectric series relationship according to the present invention will be described. Compared with the aforementioned, first and second triboelectric series relationships, the third triboelectric series relationship is different in that the triboelectric series of the toner base particle 3 is arranged on the plus side with respect to the triboelectric series of the toner carrier 1. In the relationship, it may be predicted from the second and third triboelectric series relationships that plus-charged toner base particles 3 are produced undesirably. As a result of repeated examination, it has been however found that good characteristic is obtained even in the case of the third triboelectric series relationship.

Figure 3A:
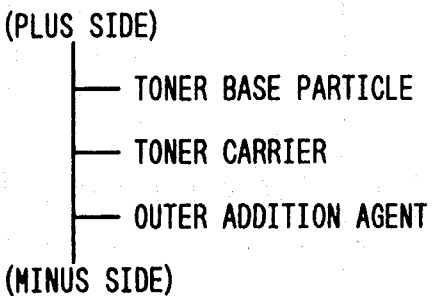
FIG. 3A is a view showing a third relationship between triboelectric series of a toner carrier, a surface additives and a toner base particle used in a developing method using negative toner according to the present invention.
Figure 3B:
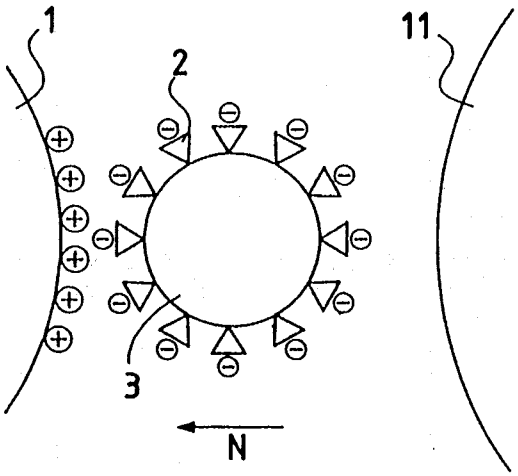
FIG. 3B is a view showing the charge polarity in the case where the surface additives is not deposited on a surface of the toner carrier.
Figure 3C:
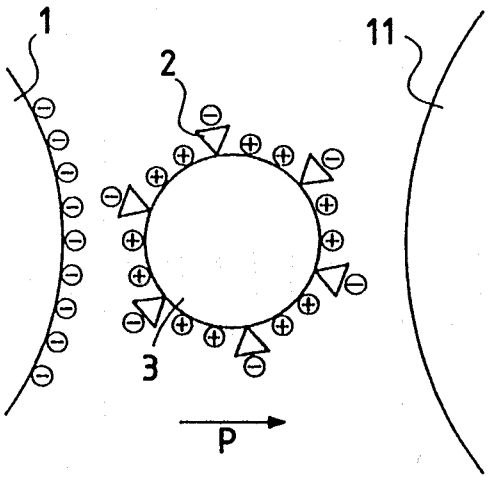
FIG. 3C is a view showing the charge polarity in the case where the covering rate of the surface additives is low, for comparison with FIG. 3B.

FIG. 3A shows the third triboelectric series relationship according to the present invention. FIG. 3B typically shows the charge polarity relationship between the toner carrier 1, the surface additives 2 and the toner base particle 3 in a development apparatus. FIG. 3C typically shows a comparative example with respect to the present invention.

When the surface additives 2 is not deposited on the toner carrier 1 as shown in FIG. 3B, the surface additives 2 being in contact with the toner carrier 1 is charged to minus on the basis of the relationship in FIG. 3A and moved to the image portion on the latent image carrier 11 by electric field N so that it is used in order to make the latent image visible. Accordingly, production of plus-charged toner base particles 3 can be prevented, that is, fogging in the ground can be eliminated.

In the case where the triboelectric series of the toner base particle 3 is arranged on the plus side with respect to the triboelectric series of the toner carrier 1 as described above, it is necessary that the triboelectric series of the surface additives 2 is arranged on the minus side with respect to the triboelectric series of the toner carrier 1.

On the other hand, in the case where the rate of covering the surface of the toner base particle 3 with the surface additives 2 is small as shown in FIG. 3C, the toner base particle 3 comes into contact with the toner carrier 1 easily and moved as positive toner to the non-image portion on the latent image carrier by electric field P in the non-image portion. As a result, fogging in the ground occurs. From the above description, even in the case where the third triboelectric series relationship according to the present invention are used, that is, in the case where the toner base particle 3 having the triboelectric series arranged on the plus side with respect to the triboelectric series of the toner carrier 1 is used, the toner base particle can be charged to plus to thereby lower fogging when the surface additives 2 arranged on the plus side with respect to the toner carrier 1 is contained in the surface of the toner base particle 3. By increasing the rate of covering of the surface of the toner carrier 1 with the surface additives 2, the toner base particle 3 can be further prevented from being charged to plus, that is, fogging in the ground can be eliminated preferably.

In the following, the case where toner for making an electrostatic latent image visible is positive toner will be described. "Positive toner" according to the present invention means toner which is such that toner on a toner carrier is transferred to an area for making an electrostatic latent image on a latent image carrier visible (hereinafter referred to as "image portion") to thereby make the electrostatic latent image visible when the direction of electric field between the latent image carrier image portion and the toner carrier changes from the latent image carrier to the toner carrier.

A fourth triboelectric series relationship according to the present invention will be described.

Figure 4C:
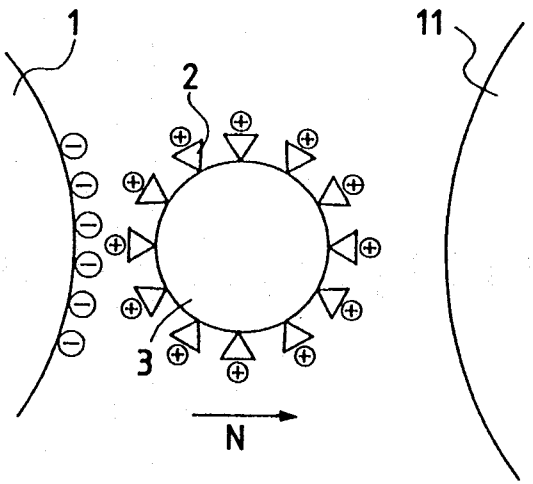
FIG. 4C is a view showing the charge polarity in the case where the surface additives is deposited on a surface of the toner carrier.
Figure 4B:
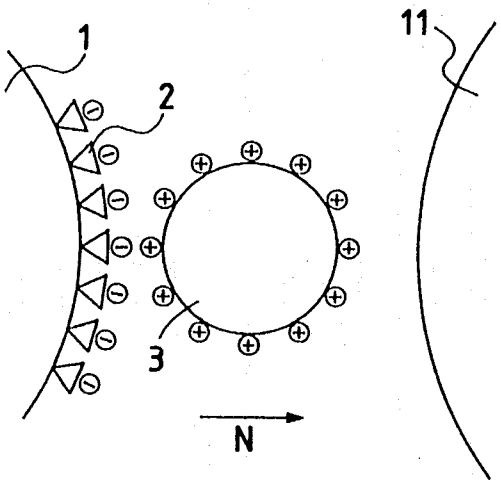
FIG. 4B is a view showing the charge polarity in the case where the surface additives is not deposited on a surface of the toner carrier.
Figure 4A:
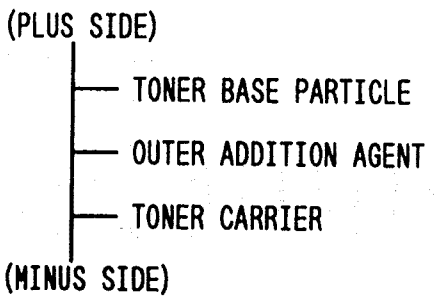
FIG. 4A is a view showing a fourth relationship between triboelectric series of a toner carrier, a surface additives and a toner base particle used in a developing method using positive toner according to the present invention.

FIGS. 4A, 4B and 4C show the case where the first triboelectric series relationship shown in FIGS. 1A, 1B and 1C is applied to positive toner. Specifically, FIG. 4A shows the fourth triboelectric series relationship according to the present invention. FIGS. 4B and 4C typically show the charge polarity relationship between the toner carrier 1, the surface additives 2 and the toner base particle 3 in a development apparatus.

In the case where the surface additives 2 is deposited on a surface of the toner carrier 1 as shown in FIG. 4B, the toner base particle 3 comes into contact with the surface additives 2 on the surface of the toner carrier 1 and is charged to minus on the basis of the relationship in FIG. 4C so that the toner base particle 3 is moved to the image portion on the latent image carrier 11 by electric field N so as to be used in order to make the latent image visible. Reversely, the surface additives 2 on the surface of the toner carrier 1 is charged to plus.

Accordingly, the toner base particle 3 is prevented from being charged to minus as a cause of fogging in the ground, so that it is used for making the latent image on the latent image carrier 11 visible. On the other hand, in the case where the surface additives 2 is not deposited on the toner carrier 1 as shown in FIG. 4C, the surface additives 2 and the toner base particle 3 being in contact with the toner carrier 1 are charged to plus in connection with FIG. 4A, so that they are used in order to make the latent image on the latent image carrier 11 visible in the same manner as in FIG. 4B.

As described above, by arranging the respective members so that triboelectric series of the toner carrier 1, the toner base particle 3 and the surface additives 2 have a relationship of order shown in FIG. 4A, production of minus-charged toner base particles 3 is prevented regardless of the presence or absence of the surface additives 2 deposited on the surface of the toner carrier 1. Accordingly, unnecessary toner can be prevented from being deposited on the non-image portion, that is, fogging in the ground can be eliminated.

In the following, a fifth triboelectric series relationship according to the present invention will be described.

Figure 5C:
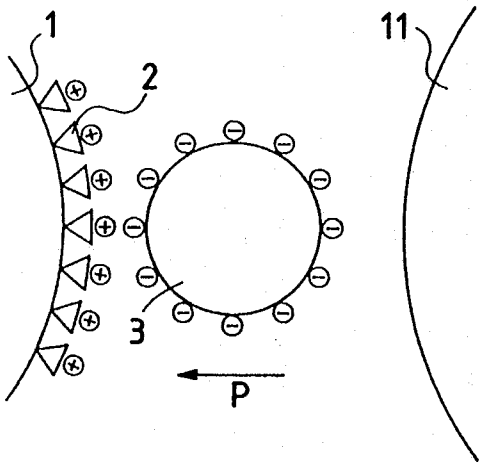
FIG. 5C is a view showing the charge polarity in the case where the surface additives is deposited on a surface of the toner carrier, for comparison with FIG. 5B.
Figure 5B:
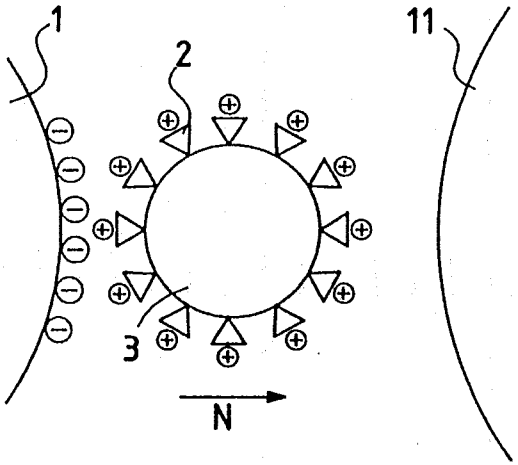
FIG. 5B is a view showing the charge polarity in the case where the surface additives is not deposited on a surface of the toner carrier.
Figure 5A:
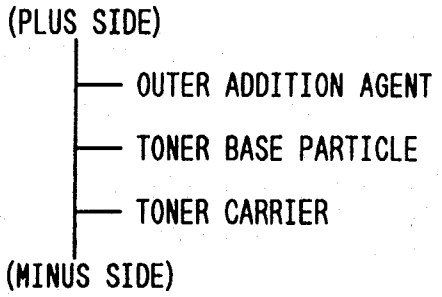
FIG. 5A is a view showing a fifth relationship between triboelectric series of a toner carrier, a surface additives and a toner base particle used in a developing method using positive toner according to the present invention.

FIGS. 5A, 5B and 5C show the case where the second triboelectric series relationship shown in FIGS. 2A, 2B and 2C is applied to positive toner. Specifically, FIG. 5A shows the fifth triboelectric series relationship. FIG. 5B typically shows the charge polarity relationship between the toner carrier 1, the surface additives 2 and the toner base particle 3 in a development apparatus. FIG. 5C typically shows a comparative example for explaining FIG. 5B.

In this occasion,i when the surface additives 2 is not deposited on the toner carrier 1 as shown in FIG. 5B, the surface additives 2 and the toner carrier 3 being in contact with the toner carrier 1 are charged to plus on the basis of the relationship in FIG. 5A and moved to the image portion on the latent image carrier 11 by electric field N so that they are used in order to make the latent image visible. Accordingly, production of plus-charged toner base particles 3 can be prevented, that is, fogging in the ground can be eliminated.

On the other hand, when the surface additives 2 is deposited on the toner carrier 1 as shown in FIG. 5C, the toner base particle 3 being in contact with the surface additives 2 is charged to plus and moved to the non-image portion on the latent image carrier 11 by electric filed P in the non-image portion. As a result, fogging in the ground occurs. Accordingly, in the fifth triboelectric series relationship according to the present invention, it is preferable that the surface additives 2 is not deposited on the toner carrier 1.

In the following, a sixth triboelectric series relationship according to the present invention will be described.

Figure 6A:
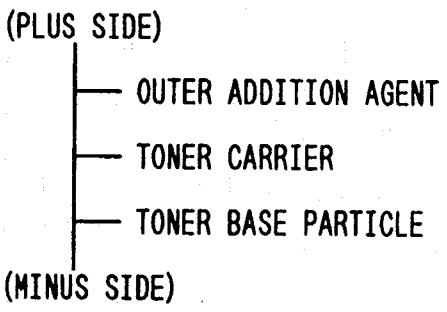
FIG. 6A is a view showing a sixth relationship between triboelectric series of a toner carrier, a surface additives and a toner base particle used in a developing method using positive toner according to the present invention.
Figure 6B:
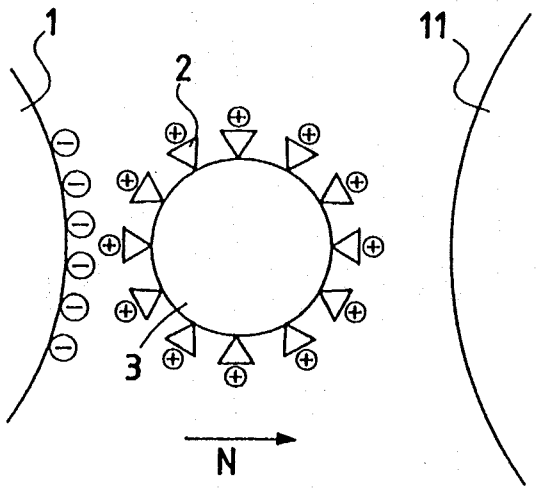
FIG. 6B is a view showing the charge polarity in the case where the surface additives is not deposited on a surface of the toner carrier.
Figure 6C:
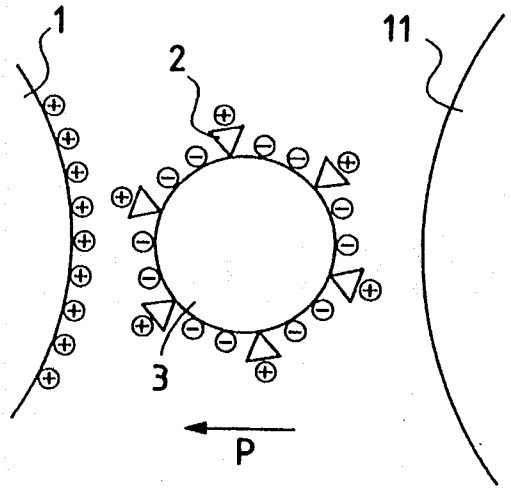
FIG. 6C is a view showing the charge polarity in the case where the covering rate of the surface additives is low, for comparison with FIG. 6B.

FIGS. 6A, 6B and 6C show the case where the third triboelectric series relationship shown in FIGS. 3A, 3B and 3C are applied to positive toner. Compared with the aforementioned, fourth and fifth triboelectric series relationships, the sixth triboelectric series relationship is different in that the triboelectric series of the toner base particle 3 is arranged on the minus side with respect to the triboelectric series of the toner carrier 1.

In the relationship, it may be predicted from the fourth and fifth triboelectric series relationships that minus-charged toner base particles 3 are produced undesirably. As a result of repeated examination, it has been however found that good characteristic is obtained even in the case of the sixth triboelectric series relationship. Specifically, FIG. 6A shows the sixth triboelectric series relationship according to the present invention. FIG. 6B typically shows the charge polarity relationship between the toner carrier 1, the surface additives 2 and the toner base particle 3 in a development apparatus. FIG. 6C typically shows a comparative example with respect to the present invention.

When the surface additives 2 is not deposited on the toner carrier 1 as shown in FIG. 6B, the surface additives 2 being in contact with the toner carrier 1 is charged to plus on the basis of the relationship in FIG. 6A and moved to the image portion on the latent image carrier 11 by electric field N so that it is used in order to make the latent image visible. Accordingly, production of minus-charged toner base particles 3 can be prevented, that is, fogging in the ground can be eliminated.

In the case where the triboelectric series of the toner base particle 3 is arranged on the minus side with respect to the triboelectric series of the toner carrier 1 as described above, it is necessary that the triboelectric series of the surface additives 2 is arranged on the plus side with respect to the triboelectric series of the toner carrier 1.

On the other hand, in the case where the rate of covering the surface of the toner base particle 3 with the surface additives 2 is small as shown in FIG. 6C, the toner base particle 3 comes into contact with the toner carrier 1 easily and moved as negative toner to the non-image portion on the latent image carrier 11 by electric field P in the non-image portion. As a result, fogging in the ground occurs. From the above description, even in the case where the sixth triboelectric series relationship according to the present invention are used, that is, in the case where the toner base particle 3 having the triboelectric series arranged on the minus side with respect to the triboelectric series of the toner carrier 1 is used the toner base particle 3 can be prevented from being charged to minus, that is, fogging can be lowered when the surface additives 3 arranged on the plus side with respect to the toner carrier 1 is contained in the surface of the toner base particle 3. By increasing the rate of covering of the surface of the toner carrier 1 with the surface additives 2, the toner base particle 3 can be further prevented from being charged to minus, that is, fogging in the ground can be eliminated preferably.

Figure 7:
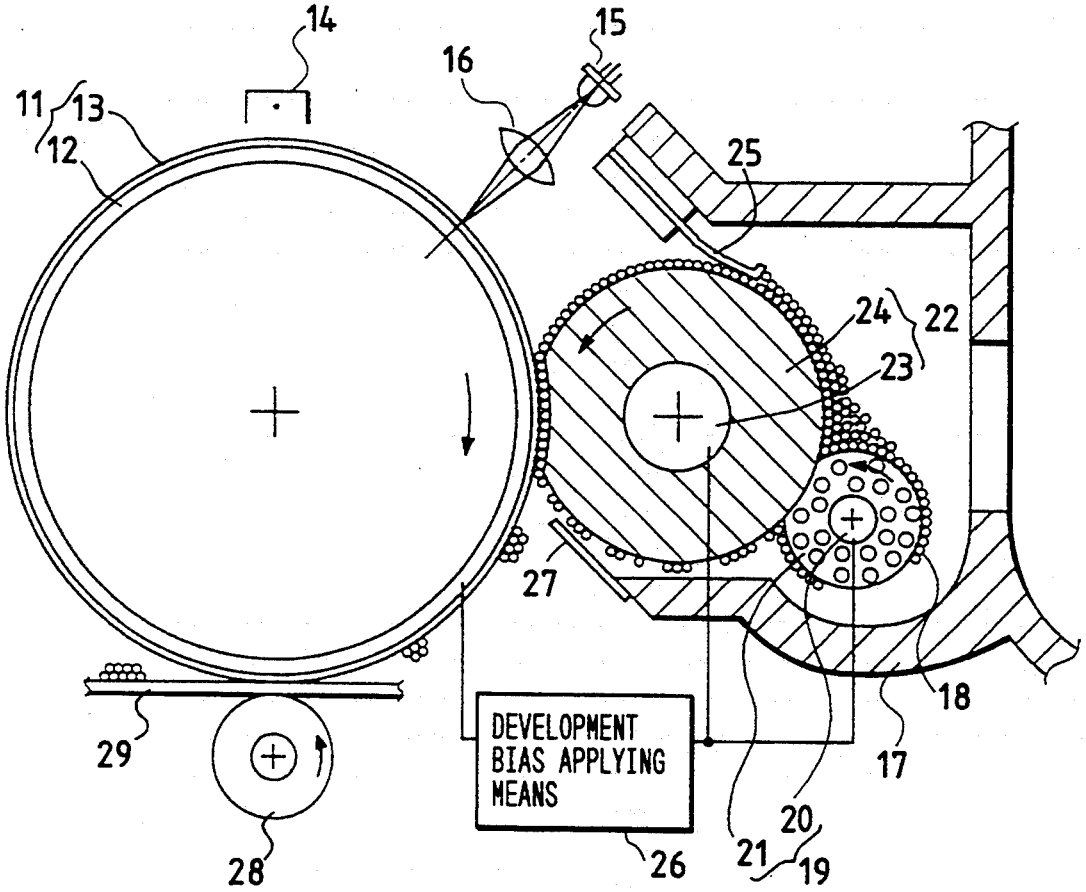
FIG. 7 is a sectional outline view of a image forming apparatus constituted by a developing method used in embodiments of the present invention.

Next, a sectional outline view of an image forming apparatus as an embodiment using a developing method constituted by a toner carrier 1, a toner base particle 3 and a surface additives 2 having the first to sixth triboelectric series relationships according to the present invention is shown in FIG. 7.

In FIG. 7, an organic or inorganic photosensitive layer 13 having photoconductivity is formed on a conductive supporting portion 12 to thus prepare a latent image carrier 11. With respect to the latent image carrier 11, the photosensitive layer 13 is charged to a predetermined potential by a charger 14 such as a corona charger, a charge roller, etc. After the latent image carrier 11 is charged as described above, light emitted from a light source 15 such as a laser, an LED, etc. is radiated onto the photosensitive layer 13 selectively in accordance with the image through an image-forming optical system 16 such as a scan optical system using a plurality of lenses and a polygon scanner, an equimultiple image-forming system using a fiber array, etc. to thereby obtain potential contrast on the latent image carrier 11 to thus form an electrostatic latent image pattern.

On the other hand, a development apparatus 17 conveys toner 18 to perform development. A supply member 19 for supplying toner 18 has a foam member 21 arranged concentrically on the outer circumference of a shaft 20. A toner carrier 22 for conveying toner 18 has a conductive elastic material 24 arranged concentrically on the outer circumference of a shaft 23. Toner 18 supplied to the vicinity of the toner carrier 22 by the supply member 19 is held on the toner carrier 22. Thin layer regulation is performed by a plate-like regulating member 25 constituted by a nonmagnetic or magnetic metal/resin, so that a suitable amount of toner is obtained. The thin-film toner 18 is conveyed by rotation of the toner carrier 22 and supplied to a development portion. The toner carrier 22 is pressed against the latent image carrier 11 by a predetermined amount of pressure. When toner 18 is conveyed to the development portion in which the latent image carrier 11 and the toner carrier 22 come into contact with each other, toner 18 charged in accordance with development electric field by the potential contrast of the latent image carrier 11 and a development bias applying means 26 is transferred to the latent image carrier 11 to thereby make the electrostatic latent image pattern visible.

In this occasion, a development bias is applied to perform reversal development or ordinary development in accordance with the charge polarity of the toner 18. Further, a seal member 27 is disposed in an opening portion of the development apparatus 17. By arranging the seal member 27 so as to slightly touch the toner carrier 22, toner is prevented from dropping down after development or scattering from the inside of the development apparatus 17.

Further, toner 18 developed on the latent image carrier 11 is transferred to a recording material 29 by applying a voltage to a transfer member 28 such as a transfer roller, a transfer belt, etc. which is suspended to an elastic material such as a spring, etc. so as to be brought into forced contact with the latent image carrier 11 by a light load of the order of several gf/mm. The toner transferred on the recording material 29 is fixed onto the recording member 29 by heat or pressure, so that a desired image is obtained. After transferring, the latent image carrier 11 rotates so that transfer residual toner for foreign matter deposited on the latent image carrier 11 is removed by a cleaning apparatus not shown and, at the same time, unnecessary electric charges on the latent image carrier 11 are removed by a discharger not shown. Then, charging is performed again, so that images are formed continuously by repetition of the aforementioned process.

Recycling of toner may be performed so that toner collected by cleaning is fed back to the development apparatus 17 again. In the following, examples of experiments using the image forming apparatus shown in FIG. 7 will be described for explaining the present invention in detail.

Experimental Example 1

An experimental example with respect to the first triboelectric series relationship according to the present invention, specifically the relationship between triboelectric series shown in FIG. 1A and 1B, and with respect to the toner carrier, the surface additives and the toner base particle in the case where the surface additives is deposited on a surface of the toner carrier will be described. Four kinds of toner carriers shown in Table 1 were used as the toner carrier.

TABLE 1

| Toner Carrier | Material |
|---|---|
| A | Urethane Rubber (Single Layer) |
| B | NBR (Single Layer) |
| C | Base Material: EPDM, Surface: Urethane Resin (Two Layers) |
| D | Base Material: EPDM, Surface: Nickel Electro-cast Tube (Two Layers) |

Further, characteristics of the aforementioned toner carriers are shown in Table 2.

TABLE 2

| Toner Carrier | Hardness (JIS A) | Resistance (Ω) | Surface Roughness Rz (μm) |
|---|---|---|---|
| A | 45 | $5 \times 10^6$ | 6 |
| B | 50 | $1 \times 10^7$ | 5 |
| C | 48 | $1 \times 10^6$ | 3 |
| D | 55 | $5 \times 10^5$ | 2 |

A toner carrier having an outer diameter of 20ϕ and a length of 230 mm was used as the toner carrier. Further, resistance was calculated on the basis of a voltage in the case where a current of 1 μA was applied in the condition in which loads of 500 g, that is, load of 1 kg in total, were imposed respectively on opposite ends of a plate electrode after the toner carrier was put on the plate electrode.

Further, surface roughness was obtained by a scan type laser microscope (made by Laser Tec Corp.). Further, an urethane sponge roller having a mean cell size of 300 μm, a cell density of 4/mm and a resistance of $10^7$ Ωcm was used as the supply member. A metal blade made of stainless steel and having a thickness of 0.2 mm was used as the toner layer (thickness) regulating member.

In the following, toner used in this Experimental Example 1 will be described. Components of the toner are shown as follows.

| | |
|---|---|
| Polyester Resin | 88 wt % |
| Polypropylene Wax | 5 wt % |
| Negatively Electrified Charge Control Agent | 1 wt % |
| Carbon Black | 6 wt % |

Raw materials shown in the aforementioned proportion were used. The raw materials were kneaded by a screw extruder and ground roughly. Then, they were ground finely by a jet grinder and classified to thus prepare toner base particles A with the volume mean particle size of 9 μm. Then, toner Aa having a surface additives a with the particle size of 0.016 μm contained in a surface of 0.8 wt % toner base particles was prepared by using a Henschel mixer. The condition for mixing by the Henschel mixer was 2000 rpm-10 sec. Dry process silica having a surface treated with dimethylsilicone oil was used as the surface additives a. The hydrophobing rate in the surface additives was not smaller than 60%.

Further, toner resistance was $5\times10^{17}$ Ωcm. Further, triboelectric series of the aforementioned materials were found. The triboelectric series were determined by measurement in which polarity was examined by a surface potentiometer while samples were brought into slight contact with each other and rubbed with each other.

In this occasion, the surface additives and the toner base particle were provided as pellets formed by a pressure pellet former. By using such pellets, the triboelectric series of the respective samples were determined.

Results of the triboelectric series are shown in FIG. 8. It is apparent from FIG. 8 that not only the surface additives a is arranged on the plus side with respect with the toner base particle A but the toner carrier is arranged on the plus side with respect to the surface additives a in any case of the four kinds of toner carriers. It is further apparent that a regulating member constituted by a metal blade made of stainless steel and a supply member constituted by urethane sponge are arranged on the plus side with respect to the surface additives a. By arranging the regulating member and the supply member on the plus side with respect to the surface additives and the toner base particle, the surface additives and the toner base particle can be charged to the minus side through contact with the regulating member and the supply member.

Accordingly, production of plus-charged toner caused by the regulating member and the supply member can be prevented. Then, with use of the aforementioned, toner carrier (A, B, C and D), toner, supply member and toner layer (thickness) regulating member, an image was formed by an image forming apparatus shown in FIG. 7. In this occasion, a latent image carrier for minus charge was used as the latent image carrier and the surface potential thereof was set to be −600 V. The development bias applied between the toner carrier and the latent image carrier was −250 V.

With respect to the image, an all-white pattern (no printing), an all-black pattern and a test pattern were printed successively to thereby evaluate the image. Particularly the amount of toner deposited on the latent image carrier in the case of all-white printing was measured as the quantity of fogging toner. With respect to the measurement, after fogging toner on the photosensitive material was deposited onto a tape (Scotch Mending Tape 810, made by 3M Corp.), weights before and after the deposition were measured by an electronic balance so that the difference between the weights was made the quantity of fogging toner. Results are shown in Table 3.

TABLE 3

| Toner | Toner Carrier | Quantity of Fogging Toner on Latent Image Carrier |
|---|---|---|
| Aa | A | 0.005 mg/cm$^2$ |
| Aa | B | 0.004 mg/cm$^2$ |
| Aa | C | 0.007 mg/cm$^2$ |
| Aa | D | 0.002 mg/cm$^2$ |

As described above, the quantity of fogging toner on the latent image carrier was not larger than 0.01 mg/cm$^2$. Further, recording materials subjected to all-white printing and test-pattern printing were observed by an optical microscope. As a result, a high-quality image almost free from fogging could be formed.

Further, even in the case where running printing up to 10000 sheets was carried out, a good image free from fogging could be formed so that the image on the last sheet was equal to the image on the first sheet. Further, the same test as described above was carried out under the condition of a high temperature of 35° C. and a high humidity of 65% and under the condition of a low temperature of 10° C. and a low humidity of 15%, respectively. As a result, a good image could be formed stably so as to be free from remarkable deterioration of image quality.

After running printing up to 10000 sheets, the surface of the toner carrier was observed by eyes and by a microscope. As a result, the fact that the surface of the toner carrier was covered with white fine powder was observed in each case of the four kinds of toner carriers. The white fine powder with which the surface of the toner carrier was covered was analyzed by an X-ray micro analyzer. As a result, it was found that the white fine power was silica used. Consequently, it is apparent from the result of Experimental Example 1 that even in the case where the surface additives is deposited on the surface of the toner carrier, as shown in FIG. 1, a good image free from fogging can be formed as long as triboelectric series have a relationship in which the toner carrier, the surface additives and the toner base particle are arranged in this order from the plus side.

Experimental Example 2

In the following, an experimental example in the case shown in FIG. 1C is shown. A toner carrier having very low tacking property in its surface, that is, having property in which the surface additives is hard to be deposited, was used as the toner carrier. The material for the toner carrier used in this experimental example is shown in Table 4.

TABLE 4

| Toner Carrier | Material |
|---|---|
| E | Base Material: EPDM, Nylon resin (Two Layers) |

Further, characteristic is shown in Table 5.

TABLE 5

| Toner Carrier | Hardness (JIS A) | Resistance (Ω) | Surface Roughness Rz (μm) |
|---|---|---|---|
| E | 45 | $5 \times 10^6$ | 3 |

The same supply member and the same toner layer (thickness) regulating member as used in Experimental Example 1 were used. The same toner base particle A and the same surface additives a as used in Experimental Example 1 were used. Triboelectric series of the respective members used in this experimental example were shown in Table 8. Image forming and image evaluation were carried out in the same manner as in Experimental Example 1. As a result, similarly to Experimental Example 1, a good image could be formed. The quantity of fogging toner on the latent image carrier is shown in Table 6.

TABLE 6

| Toner | Toner Carrier | Quantity of Fogging Toner on Latent Image Carrier |
|---|---|---|
| Aa | Toner Carrier E | 0.004 mg/cm$^2$ |

After running test, the surface of the toner carrier was observed in the same manner as in Experimental Example 1. As a result, there was no observation of deposition of the white surface additives, unlike Experimental Example 1.

As described above, by using the toner carrier E having property in which the Surface additives a is hard to be deposited, a good image free from fogging can be formed as long as the triboelectric series have a relationship of FIG. 1 in which the toner carrier, the surface additives and the toner base particle are arranged in this order from the plus side as shown in FIG. 1C.

Comparative Example 1

In the following,the case of the triboelectric series relationship shown in FIG. 9 will be described as a comparative example with respect to Experimental Example 1 in which the first triboelectric series relationship has been described. A surface additives b treated with aminosilane was used as the surface additives. The surface additives b was contained in the toner base particle A in the same manner as in Experimental Example 1 to thus prepare toner Ab. Then, image forming was carried out in the same manner as in Experimental Example 1, so that the quantity of fogging toner on the latent image carrier was examined. Results are shown in Table 7. .AW off

TABLE 7

| Toner | Toner Carrier | Quantity of Fogging Toner on Latent Image Carrier |
|---|---|---|
| Ab | A | 0.065 mg/cm$^2$ |
| Ab | B | 0.088 mg/cm$^2$ |
| Ab | C | 0.058 mg/cm$^2$ |

It becomes clear from above that when a surface additives having a triboelectric series arranged on the plus side with respect to the triboelectric series of the toner carrier is used, the quantity of fogging toner increases remarkably so that image quality deteriorates remarkably. This is considered to be based on the fact that the probability of charging toner Ab to plus is increased by contact between the toner Ab and the toner carrier. That is, in the case where the triboelectric series have a relationship in which the surface additives, the toner carrier and the toner base particle are arranged in this order from the plus side, fogging increases undesirably.

Experimental Example 3

In the following, an experimental example in the second triboelectric series relationship according to the present invention, specifically, the triboelectric series relationship according to the present invention shown in FIGS. 2A and 2B, and with respect to the toner carrier, the surface additives and the toner base particle in the case where the surface additives is not deposited on the surface of the toner carrier will be shown. In this experimental example, a toner carrier E was used.

In this experimental example, a surface additives c having its surface treated with hexamethyldisilazane was used. The surface additives c was contained in the toner base particle A in the same manner as in Experimental Example 1 to thus prepare toner Ac. Triboelectric series of the respective members used in this experimental example are shown in FIG. 10. It is apparent from FIG. 10 that the toner base particle A is positioned on the plus side with respect to the surface additives c. Then, an image was formed in the same manner as in Experimental Example 1. As a result, a good image similar to that in Experimental Example 1 could be formed. The quantity of fogging toner on the latent image carrier is shown in Table 8.

TABLE 8

| Toner | Toner Carrier | Quantity of Fogging Toner on Latent Image Carrier |
|---|---|---|
| Aa | E | 0.005 mg/cm$^2$ |

The surface of the toner carrier was observed in the same manner as in Experimental Example 1. As a result, there was no observation of deposition of the white surface additives, like Experimental Example 2. It is apparent from above and Experimental Example 2 that the surface additives arranged on the minus side with respect to the toner base particle can be used as long as a toner carrier having property in which the surface additives is hard to be deposited is used. That is, a good image can be formed when the triboelectric series has a relationship in which the toner carrier, the toner base particle and the surface additives are arranged in this order from the plus side, if the surface additives is not deposited on the toner carrier.

Experimental Example 4

In this experimental example, the surface additives c used in Experimental Example 3 was replaced by a surface additives having =its surface treated with dimethyldichlorsilane. The triboelectric series was arranged in the more plus side compared with the surface additives c. Image forming and image evaluation were carried out in the same manner as in Experimental Example 3. As a result, a good image similar to that in Experimental Example 3 could be formed.

Comparative Example 2

In the following, the case of the triboelectric series relationship shown in FIG. 11 will be described as a comparative example with respect to Experimental Example 3 in which the second triboelectric series relationship according to the present invention have been described. By using toner carriers A, B, C and D as used in Experimental Example 1 and toner Ac constituted by a surface additives c and a toner base particle A as used in experimental Example 3, image forming was carried out in the same manner as in Experimental Example 3. Results are shown in Table 9.

TABLE 9

| Toner | Toner Carrier | Quantity of Fogging Toner on Latent Image Carrier |
|---|---|---|
| Ac | A | 0.030 mg/cm$^2$ |
| Ac | B | 0.025 mg/cm$^2$ |
| Ac | C | 0.037 mg/cm$^2$ |
| Ac | D | 0.020 mg/cm$^2$ |

As shown in this Table, the quantity of fogging toner on the latent image carrier was larger than that in Experimental Example 3, so that a good image could not be formed. The surface of the toner carrier was observed in the same manner as in Experimental Example 3. As a result, the fact that white fine powder was deposited was observed like Experimental Example 1. As a result of analysis, it was found that the white fine power was the surface additives used. This is considered to be caused by the fact that the surface additives c is deposited on the surface of the toner carrier to thereby charge the toner base particle A to plus. That is, in the case where the surface additives is deposited on the surface of the toner carrier, fogging increases undesirably if the triboelectric series have a relationship in which the toner carrier, the toner base particle and the surface additives are arranged in this order from the plus side.

Experimental Example 5

In the following, an experimental example in the third triboelectric series relationship according to the present invention, specifically, the triboelectric series relationship shown in FIG. 3A, 3B and 3C, and with respect to the influence of the quantity of the surface additives on the surface of the toner base particle will be shown. A toner carrier shown in Table 10 was used as the toner carrier.

TABLE 10

| Toner Carrier | Material |
|---|---|
| F | Base Material: Silicon, Surface: Fluorine Resin (Two Layers) |

Further, characteristic is shown in Table 11.

TABLE 11

| Toner Carrier | Hardness (JIS A) | Resistance (Ω) | Surface Roughness Rz (μm) |
|---|---|---|---|
| F | 45 | $5 \times 10^6$ | 4 |

Further, toner Ac constituted by a surface additives and a toner base particle A was used. As the other members, the same supply member and the same toner layer (thickness) regulating member as in Experimental Example 1 were used. The triboelectric series of the members used in this experimental example are shown in FIG. 12. It is apparent from the drawing that the toner base particle A in this experimental example has a tendency in which it is charged to plus when it is brought into contact with the toner carrier F.

Figure 13:
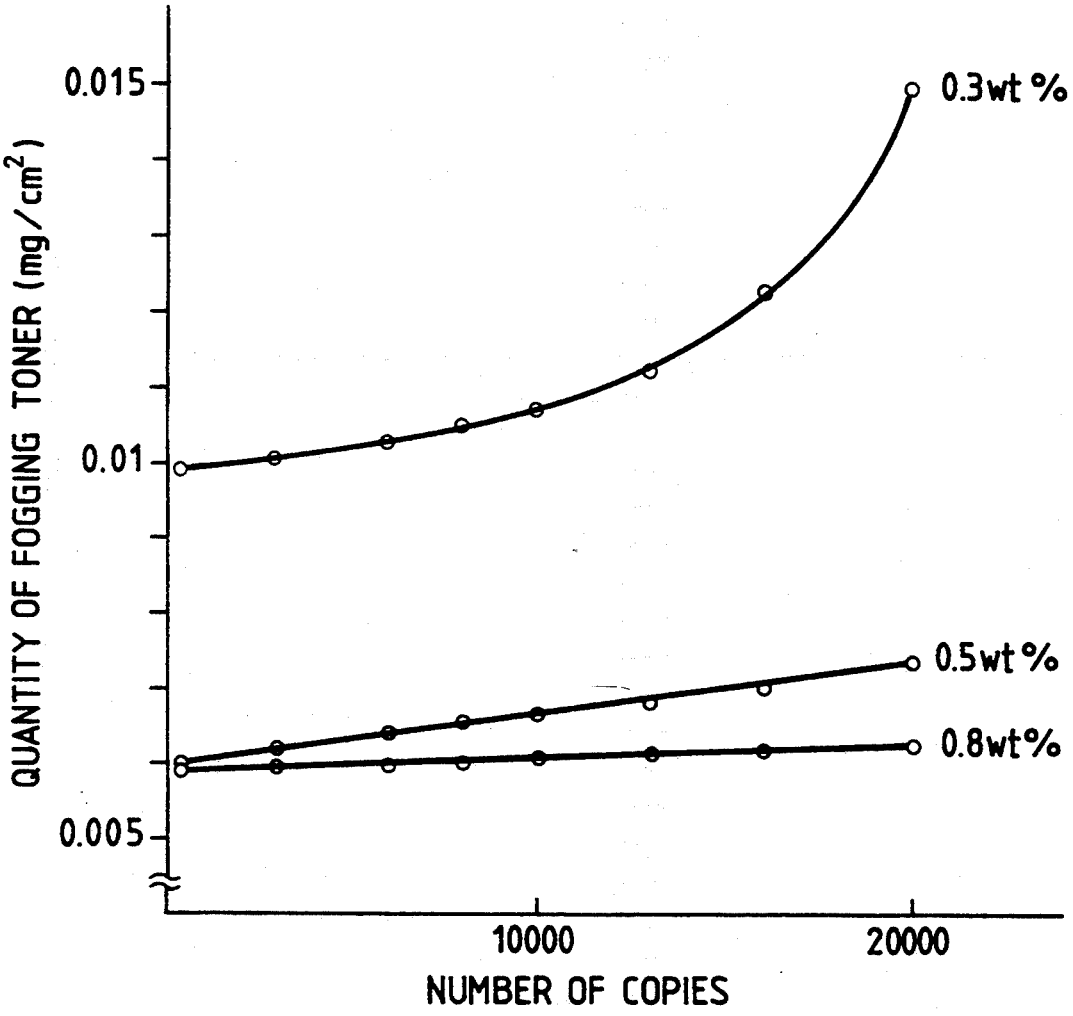
FIG. 13 is a view showing the relation between the number of sheets subjected to printing and the quantity of fogging in Experimental Example 5 according to the present.

Accordingly, it is necessary to increase the surface additives content. In this experimental example, the quantity of the surface additives was changed to 0.3 wt %, 0.5 wt % and 0.8 wt % successively. Results are shown in FIG. 13. It is apparent from FIG. 13 that in the case of the surface additives content of 0.3 wt %, a substantially good image can be formed though more or less fogging occurs in the initial and running stages and increases gradually.

In the case of the surface additives content of 0.5 wt %, a good image can be formed though fogging increases slightly at the time of running. Further, in the case of the surface additives content of 0.8 wt % a good image can be formed because there is no fogging in the initial and running stages. Further, the surface of the toner carrier was observed in the same manner as in Experimental Example 1. As a result, there was no deposition of the white surface additives. Accordingly, the surface additives content is preferably not smaller than 0.5 wt % , more preferably, not smaller than 0.8 wt %. It was found that a good image free from fogging could be formed by optimizing the kind of the surface additives (charged to minus with respect to the toner carrier) and the amount of the surface additives even in the case where a toner base particle having a triboelectric series arranged on the plus side with respect to the triboelectric series of the toner carrier was used as described above. That is, it is preferable that the triboelectric series have a relationship in which the toner base particle, the toner carrier and the surface additives are arranged in this order from the plus side.

In the following, experimental examples in the fourth, fifth and sixth triboelectric series relationships using positive toner will be described.

Experimental Example 6

In the following, an experimental example in the fourth triboelectric series relationship according to the present invention, specifically, the triboelectric series relationship according to the present invention shown in FIGS. 4A and 4B, and with respect to the toner carrier, the surface additives and the toner base particle in the case where the surface additives is deposited on the surface of the toner carrier will be shown. Two kinds of toner carriers shown in Table 12 were used as the toner carrier.

TABLE 12

| Toner Carrier | Material |
|---|---|
| G | EPDM (Single Layer) |
| H | Silicon (Single Layer) |

Further, characteristics are shown in Table 13.

TABLE 13

| Toner Carrier | Hardness (JIS A) | Resistance (Ω) | Surface Roughness Rz (μm) |
|---|---|---|---|
| G | 43 | $1 \times 10^6$ | 4 |
| H | 48 | $5 \times 10^5$ | 7 |

Further, the same supply member and the same toner layer (thickness) regulating member as in Experimental Example 1 were used. In the following, toner used in this Experimental Example 5 will be described. Components of the toner are shown as follows.

| | |
|---|---|
| Styrene Acryl Resin | 88 wt % |
| Polypropylene Wax | 5 wt % |
| Positively Electrified Charge Control Agent | 1 wt % |
| Carbon Black | 6 wt % |

By using raw materials shown in the aforementioned proportion, toner base particles B with the volume mean particle size of 9 μm was prepared in the same manner as Experimental Example 1. Next, a surface additives treated with aminosilane was used as the surface additives so that toner Bb in which a toner base particle B contains the surface additives b was prepared in the same manner as Experimental Example 1. Toner resistance was $5\times10^{17}$ Ωcm.

Further, triboelectric series of the samples were found in the same manner as in Experimental Example 1. Results of the triboelectric series are shown in FIG. 14. From FIG. 14, the surface additives b is arranged on the minus side with respect to the toner base particle B and the toner carrier is arranged on the minus side with respect to the surface additives b in each case of the two kinds of toner carriers. It is further apparent that a regulating member constituted by a metal blade made of stainless steel and a supply member constituted by urethane sponge are arranged on the minus side with respect to the surface additives b.

By arranging the regulating member and the supply member on the minus side with respect to the surface additives and the toner base particle, the surface additives and the toner base particle can be charged to the plus side through contact with the regulating member and the supply member. Accordingly, production of minus-charged toner caused by the regulating member and the supply member can be prevented. Then, an image was formed by using the aforementioned, toner carriers (G and H), toner, supply member and toner layer (thickness) regulating member in the same manner as in Experimental Example 1.

In this occasion, a latent image carrier for plus charge was used as the latent image carrier and the surface potential thereof was set to be +600 V. The development bias applied between the toner carrier and the latent image carrier was +250 V. Further, image evaluation was carried out in the same manner as in Experimental Example 1. Results are shown in Table 14.

TABLE 14

| Toner | Toner Carrier | Quantity of Fogging Toner |
|---|---|---|
| Bb | G | 0.005 mg/cm$^2$ |
| Bb | H | 0.004 mg/cm$^2$ |

As described above, the quantity of fogging toner on the latent image carrier was not larger than 0.01 mg/cm$^2$. Further, recording materials subjected to all-white printing and test-pattern printing were observed by an optical microscope. As a result, a high-quality image almost free from fogging could be formed.

Further, even in the case where running printing up to 10000 sheets was carried out, a good image free from fogging could be formed so that the image on the last sheet was equal to the image on the first sheet. Further, the same test as described above was carried out under the condition of a high temperature of 35° C. and a high humidity of 65% and under the condition of a low temperature of 10° C. and a low humidity of 15%, respectively. As a result, a good image could be formed stably so as to be free from remarkable deterioration of image quality.

After running printing up to 10000 sheets, the surface of the toner carrier was observed by eyes and by a microscope. As a result, the fact that the surface of the toner carrier was covered with white fine powder was observed in each case of the two kinds of toner carriers. The white fine powder with which the surface of the toner carrier was covered was analyzed by an X-ray micro analyzer. As a result, it was found that the white fine power was silica used. Consequently, it is apparent from the result of Experimental Example 6 that even in the case where the surface additives is deposited on the surface of the toner carrier, a good image free from fogging can be formed as long as triboelectric series have a relationship in which the toner carrier, the surface additives and the toner base particle are arranged in this order from the minus side as shown in FIG. 4.

Experimental Example 7

In the following, an experimental example in the case shown in FIG. 4C is shown. A toner carrier F used in Experimental Example 5, that is, a toner carrier having property in which the surface additives is hard to be deposited, was used as the toner carrier.

Further, the same supply member and the same toner layer (thickness) regulating member as in Experimental Example 6 were used. Further, the same toner base particle B and the same surface additives b as in Experimental Example 6 were used. Further, image forming and image evaluation were carried out in the same manner as in Experimental Example 6. As a result, a good image similar to that in Experimental Example 6 could be formed. The quantity of fogging toner on the latent image carrier is shown in Table 15.

TABLE 15

| Toner | Toner Carrier | Quantity of Fogging Toner on Latent Image Carrier |
|---|---|---|
| Bb | F | 0.004 mg/cm$^2$ |

After running test, the surface of the toner carrier was observed in the same manner as in Experimental Example 6. As a result, there was no observation of deposition of the white surface additives, unlike Experimental Example 6.

As described above, by using the toner carrier F having property in which the surface additives b is hard to be deposited, a good image free from fogging can be formed as long as the triboelectric series of FIG. 4 have a relationship in which the toner carrier, the surface additives and the toner base particle are arranged in this order from the minus side as shown in FIG. 4C.

Comparative Example 3

In the following the case of the triboelectric series relationship shown in FIG. 15 will be described as a comparative example with respect to Experimental Example 6 in which the fourth triboelectric series relationship according to the present invention has been described. A surface additives c treated with hexamethyldisilane was used as the surface additives. The surface additives c was contained in the toner base particle B in the same manner as in Experimental Example 6 to thus prepare toner Bc. Then, image forming was carried out in the same manner as in Experimental Example 6, so that the quantity of fogging toner on the latent image carrier was examined. Results are shown in Table 16.

TABLE 16

| Toner | Toner Carrier | Quantity of Fogging Toner on Latent Image Carrier |
|---|---|---|
| Bc | G | 0.075 mg/cm$^2$ |
| Bc | H | 0.081 mg/cm$^2$ |

It becomes clear from above that when a surface additives having a triboelectric series arranged on the minus side with respect to the triboelectric series of the toner carrier is used, the quantity of fogging toner increases remarkably so that image quality deteriorates remarkably. This is considered to be based on the fact that the probability of charging toner Bc to minus is increased by contact between the toner Bc and the toner carrier. That is, in the case where triboelectric series have a relationship in which the surface additives, the toner carrier and the toner base particle are arranged in this order from the minus side, fogging increases undesirably.

Experimental Example 8

In the following, an experimental example in the fifth triboelectric series relationship according to the present invention, specifically, the triboelectric series relationship according to the present invention shown in FIG. 5A and 5B, and with respect to the toner carrier, the surface additives and the toner base particle in the case where the surface additives is not deposited on the surface of the toner carrier will be shown. In this experimental example, a toner carrier F was used.

In this experimental example, a surface additives d obtained by surface-treating alumina fine powder with the particle size of 0.013 μm with aminosilane and octylsilane was used. The surface additives d was contained in the toner base particle B in the same manner as in Experimental Example 6 to thus prepare toner Bd. Triboelectric series of the respective members used in this experimental example are shown in FIG. 16. It is apparent from FIG. 16 that the toner base particle B is positioned on the minus side with respect to the surface additives d. Then, an image was formed in the same manner as in Experimental Example 6. As a result, a good image similar to that in Experimental Example 6 could be formed.

The quantity of fogging toner on the latent image carrier is shown in Table 17.

TABLE 17

| Toner | Toner Carrier | Quantity of Fogging Toner on Latent Image Carrier |
|---|---|---|
| Bd | F | 0.003 mg/cm$^2$ |

The surface of the toner carrier was observed in the same manner as in Experimental Example 6. As a result, there was no observation of deposition of the white surface additives, like Experimental Example 7.

It is apparent from above and Experimental Example 8 that the surface additives arranged on the plus side with respect to the toner base particle can be used as long as a toner carrier having property in which the surface additives is hard to be deposited is used. That is, a good image can be formed when the triboelectric series have a relationship in which the toner carrier, the toner base particle and the surface additives are arranged in this order from the minus side, if the surface additives is not deposited on the toner carrier.

Experimental Example 9

In this experimental example, the surface additives d used in Experimental Example 8 was replaced by a surface additives obtained by treating titanium oxide fine powder with the mean particle size of 0.021 μm with aminosilane and octylsilane. The triboelectric series of the surface additives was arranged in the more minus side compared with the surface additives d. The other procedure was carried out in the same manner as in Experimental Example 8. As a result, a good image similar to that in Experimental Example 8 could be formed.

Comparative Example 4

Figure 17:
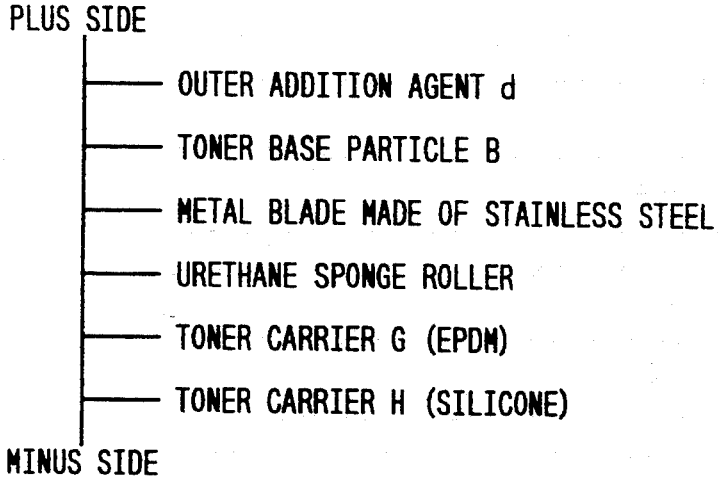
FIG. 17 is a view showing a relationship between the triboelectric series of the members used in Comparative Example 4 with respect to the present invention.

In the following, the case of the triboelectric series relationship shown in FIG. 17 will be described as a comparative example with respect to Experimental Example 8 in which the fifth triboelectric series relationship according to the present invention have been described. By using toner carriers G and H as used in Experimental Example 6 and toner Bd constituted by a surface additives d and a toner base particle B as used in experimental Example 8, image forming was carried out in the same manner as in Experimental Example 8. Results are shown in Table 18.

TABLE 18

| Toner | Toner Carrier | Quantity of Fogging Toner on Latent Image Carrier |
|---|---|---|
| Bd | G | 0.032 mg/cm$^2$ |
| Bd | H | 0.029 mg/cm$^2$ |

As shown in this Table, the quantity of fogging toner on the latent image carrier was larger than that in Experimental Example 8, so that a good image could not be formed. The surface of the toner carrier was observed in the same manner as in Experimental Example 8. As a result, the fact that white fine powder was deposited was observed like Experimental Example 6.

As a result of analysis, it was found that the white fine power was the surface additives used. This is considered to be caused by the fact that the surface additives d is deposited on the surface of the toner carrier to thereby charge the toner base particle B to minus. That is, in the case where the surface additives is deposited on the surface of the toner carrier, fogging increases undesirably if the triboelectric series have a relationship in which the toner carrier, the toner base particle and the surface additives are arranged in this order from the minus side.

Experimental Example 10

Figure 18:
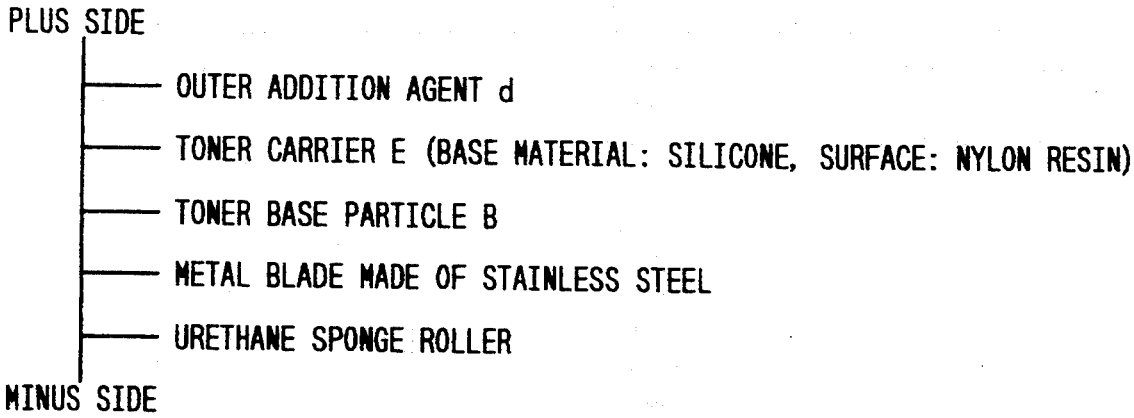
FIG. 18 is a view showing a relationship between the triboelectric series of the members used in Experimental Example 10 according to the present invention.

In the following, an experimental example in the sixth triboelectric series relationship according to the present invention, specifically, the triboelectric series relationship shown in FIG. 6A, 6B and 6C, and with respect to the influence of the quantity of the surface additives on the surface of the toner base particle will be shown. A toner carrier E was used as the toner carrier. Further, toner Bd constituted by a surface additives d and a toner base particle B was used. As the other members, the same supply member and the same toner layer (thickness) regulating member as in Experimental Example 6 were used. The triboelectric series of the members used in this experimental example are shown in FIG. 18.

It is apparent from the drawing that the toner base particle B in this experimental example has a tendency in which it is charged to minus when it is brought into contact with the toner carrier E. Accordingly, it is necessary to increase the surface additives content. In this experimental example, the quantity of the surface additives was changed to 0.3 wt %, 0.5 wt % and 0.8 wt % successively like Experimental Example 5. Results similar to those in Experimental Example 5 were obtained. Accordingly, the surface additives content is preferably not smaller than 0.5 wt %, more preferably, not smaller than 0.8 wt %. It was found that a good image free from fogging could be formed by optimizing the kind of the surface additives (charged to plus with respect to the toner carrier) and the amount of the surface additives even in the case where a toner base particle having a triboelectric series arranged on the minus side with respect to the triboelectric series of the toner carrier was used as described above. That is, it is preferable that the triboelectric series have a relationship in which the toner base particle, the toner carrier and the surface additives are arranged in this order from the minus side.

Although the above description has been made upon the case of reversal development, the present invention can be applied to the case of ordinary development. Although the above description has been made upon the relationship between the surface additives, the toner base particle and the toner carrier, the same effect is obtained even in the case where the toner base particle in the aforementioned experimental examples is replaced by toner because the position of the triboelectric series of the toner base particle is almost equal to the position of the triboelectric series of toner.

Any magnetic, nonmagnetic, conductive or insulating material, such as metal, rubber, resin, etc., can be used as the toner carrier 22 used according to the present invention as long as the material can be formed as a toner carrier. For example, from the point of view of the quality of the material, metal such as aluminum, nickel, stainless steel, etc., rubber such as natural rubber, silicon rubber, urethane rubber, butadiene rubber, chloroprene rubber, neoprene rubber, NBR, etc., and resin such as styrol resin, vinyl chloride resin, polyurethane resin, polyethylene resin, methacrylic resin, Nylon resin, etc., can be used. From the point of view of the form of the material, any materials such as non-elastic matter, elastic matter, single-layer matter, multilayer matter, film, roller, etc. can be used.

Like the toner carrier 22, with respect to the supply member 19 and the toner layer (thickness) regulating member 25 used according to the present invention, any material from the double point of view of quality and form can be used. Further, as the toner 18 used according to the present invention, toner with the particle size of 5 to 20 μm as produced generally by a kneading and grinding method, a spray drying method or a polymerizing method can be used.

Toner proportion is not limited specifically, so that general proportion can be used. For example, as binding resin used is one member or a blend of two or more members selected from the group of polystyrene and copolymers, such as hydrogenated styrene resin, styrene-isobutylene copolymer, ABS resin, ASA resin, AS resin, AAS resin, ACS resin, AES resin, styrene-P-chlorostyrene copolymer, styrene-propylene copolymer, styrene-butadiene crosslinking polymer, styrene-butadiene-chlorinated paraffin copolymer, styrene-acryl-alcohol copolymer, styrene-butadiene rubber emulsion, styrene-maleic ester copolymer, styrene-isobutylene copolymer, styrene-maleic anhydride copolymer, acrylate resin or methacrylate resin and copolymers thereof, styrene-acryl resin and copolymers thereof, such as styrene-acryl copolymer, styrene-diethylaminoethylmethacrylate copolymer, styrene-butadiene-acrylic ester copolymer, styrene-methyl methacrylate copolymer, styrene-n-butyl methacrylate copolymer, styrene-diethylamino-ethyl methacrylate copolymer, styrene-methyl methacrylate-n-butyl acrylate copolymer, styrene-methyl methacrylate-butyl acrylate-N-(ethoxymethyl) acrylamide copolymer, styrene-glycydyl methacrylate copolymer, styrene-butadiene-dimethyl-aminoethyl methacrylate copolymer, styrene-acrylic ester-maleic ester copolymer, styrene-methyl methacrylate-2-ethylhexyl acrylate copolymer, styrene-n-butyl acrylate-ethylglycol methacrylate copolymer, styrene-n-butyl methacrylate-acrylic acid copolymer, styrene-n-butyl methacrylate-maleic anhydride copolymer, styrene-butyl acrylate-isobutyl maleic half ester-divinyl benzene copolymer, polyester and copolymers thereof, polyethylene and copolymers thereof, epoxy resin, silicone resin, polypropylene and copolymers thereof, fluorine resin, polyamide resin, polyvinyl alcohol resin, polyurethane resin, polyvinyl butyral resin, etc.

As a coloring agent used is black dye/pigment such as carbon black, spirit black, nigrosine, etc. For color purpose, dyes such as phthalocyanine, rhodamine B lake, sollar pure yellow 8G, quinacridon, polytungstophosphoric acid, Indanthrene blue, sulfonamide derivatives, etc. can be used.

Further, metal soap, polyethylene glycol, etc. can be added as a dispersant. Electron-acceptable organic complex, chlorinated polyester, niitrohumic acid, quarternary ammonium salts, pyridinium salts, etc. can be added as a charge control agent. The preferred as a magnetic agent is fine powder which has a particle size of not larger than 5 μm and is chemically stable when dispersed into the binding resin. Examples of the magnetic agent used include metal powder of Fe, Co, Ni, Cr and Mn; metal oxides such as $Fe_3O_4$, $Fe_2O_3$, $Cr_2O_3$, ferrite, etc.; alloys exhibiting ferromagnetism by heat treatment such as an alloy containing manganese and copper, etc.; and so on. Pre-treatment with a coupling agent, etc. may be applied in advance.

Further, polypropylene wax, polyethylene wax, etc. can be added as a parting agent. Further, zinc stearate, zinc oxide, cerium oxide, etc. can be used as other additives. As the surface additives, various kinds of agents can be used. Examples of the surface additives used include: inorganic fine particles of metal oxides such as alumina, titanium oxide, etc., compound oxides thereof, and so on; and organic fine particles such as acrylic fine particles, etc.

Further, as surface treating agents therefor, silane coupling agents, titanate coupling agents, fluorine-containing silane coupling agents, silicone oil, and so on, can be used. The rate of hydrophobing of the surface additives treated with the aforementioned treating agent is preferably not smaller than 60% as a value measured by a conventional methanol method. If the rate is smaller than this value, lowering of frictional electric charges is undesirably caused by water adsorption under the condition of a high temperature and a high humidity.

The particle size of the surface additives is preferably in a range of from 0.001 to 1 μm. The surface additives content is preferably in a range of from 0.1 to 5 wt % with respect to the toner base particle. Further, the volume resistance of the toner used according to the present invention is preferably not smaller than $10^{17}$ Ωcm.

With respect to the method of measuring resistance, after toner is pulverized and molded into a pellet with the thickness of 0.5 mm, electrodes are put on the upper and lower portions of the pellet. Then, a current value is measured when a voltage of 250 V is applied in the condition in which a load of 1 $Kg/cm^2$ is applied. Thereafter, the current value is converted into a volume resistance value.

The measurement is carried out in the inside of a dry desicator having the inside atmosphere replaced by a nitrogen atmosphere. Although the above description of the embodiments has been made upon a one-component forced contact development system having a tendency in which fogging in the ground occurs easily, the present invention is not limited thereto. Even in the case where the invention is applied to another development system such as a nonmagnetic non-contact development system, a magnetic contact development system, a magnetic non-contact development system, etc., fogging can be reduced similarly.

Although the above description of the embodiments has been made upon the case where one kind of surface additives is used, the present invention can be applied to the case where two or more kinds of surface additives are mixed. That is, the case where the triboelectric series of a mixture of surface additives is used and the case where the respective triboelectric series of surface additives in a mixture are used are selected in accordance with the property of deposition thereof onto the toner carrier. Fogging in the ground can be reduced by selecting surface additives under the consideration of these cases.

Although embodiments have been described above, the present invention is not limited to the aforementioned embodiments. The present invention can be widely applied to image-forming apparatus using electronic photographic process. Particularly the invention is effective for application to printers, duplicators, facsimiles and displays.

As described above, according to the present invention, the triboelectric series of the toner carrier, the toner base particle and the surface additives which are constituent members of a development system using negative toner have a relationship in which: (1) the toner carrier, the surface additives and the toner base particle are arranged in this order from the plus side; (2) the toner carrier, the toner base particle and the surface additives are arranged in this order from the plus side; and there is no adhesion between the surface additives and the toner carrier; and (3) the toner base particle, the toner carrier and the surface additives are arranged in this order from the plus side; the covering rate of the surface additives is high; and there is no adhesion between the surface additives and the toner carrier, not only the toner base particle, the toner carrier and the surface additives are arranged in this order from the plus side but the surface additives is not deposited on the toner carrier.

Further, in the case of a development system using positive toner, the triboelectric series of the toner carrier, the toner base particle and the surface additives have a relationship in which: (1) the toner carrier, the surface additives and the toner base particle are arranged in this order from the minus side; (2) the toner carrier, the toner base particle and the surface additives are arranged in this order from the minus side; and there is no adhesion between the surface additives and the toner carrier; and (3) the toner base particle, the toner carrier and the surface additives are arranged in this order from the minus side; the covering rate of the surface additives is high; and there is no adhesion between the surface additives and the toner carrier, not only the toner base particle, the toner carrier and the surface additives are arranged in this order from the plus side but the surface additives is not deposited on the toner carrier.

From the above description, the invention has an effect in that a high-quality image can be formed because production of reverse polarity toner can be prevented so that deterioration of image quality caused by fogging is eliminated. Further, there arises any effect in that a high-quality image free from fogging can be formed stably against the change of time and the change of environment. Further, there arises an effect in that a good image free from fogging can be formed relatively easily by using various kinds of materials because a range for selecting materials is widened by application of the present invention.

What is claimed is:

1. A developing method of the type in which toner constituted by toner base particles and a surface additive is transferred to a latent image carrier by using a toner carrier member to make an electrostatic latent image on said latent image carrier visible, wherein the improvement comprises using a respective triboelectric series of said toner carrier member, said toner base particle and said surface additive having a predetermined relationship in an order defined from a plus or minus side, so that fogging is substantially reduced.

2. A developing method of the type in which toner constituted by toner base particles and a surface additive is transferred to a latent image carrier by using a toner carrier member to make an electrostatic latent image on said latent image carrier visible, wherein the improvement comprises using a respective triboelectric series of said toner carrier member, said toner base particle and said surface additives having a predetermined relationship in an order defined from a plus or minus side, wherein said toner is negative toner and said respective triboelectric series have a relationship in which said toner carrier member, said surface additives and said toner base particle are arranged in this order from the plus side.

3. The developing method according to claim 2, wherein said surface additive is made of fine particles treated with silicone oil.

4. The developing method according to claim 2, wherein said toner carrier member is made of urethane.

5. The developing method according to claim 2, wherein said toner carrier member is made of nitrile-butadiene rubber.

6. The developing method according to claim 2, wherein said toner carrier member is made of a metal.

7. The developing method according to claim 2, wherein a triboelectric series of a supply member is arranged on the plus side with respect to the triboelectric series of said surface additives.

8. The developing method according to claim 2, wherein a triboelectric series of a toner layer (thickness)

regulating member is arranged on the plus side with respect to the triboelectric series of said surface additives.

9. The developing method of claim 1, wherein said toner is negative toner and said respective triboelectric series have a relationship in which said toner carrier member, said toner base particle and said surface additives are arranged in this order from the plus side.

10. The developing method according to claim 9, wherein said surface additive is made of fine particles treated with hexamethyldisilazane.

11. The developing method according to claim 9, wherein said surface additive is made of fine particles treated with dimethylchlorsilane.

12. The developing method according to claim 9, wherein said toner carrier member is made of Nylon.

13. The developing method according to claim 9, wherein a triboelectric series of a supply member is arranged on the plus side with respect to the triboelectric series of said toner base particle.

14. The developing method according to claim 9, wherein a triboelectric series of a toner layer (thickness) regulating member is arranged on the plus side with respect to the triboelectric series of said toner base particle.

15. The developing method of claim 1, wherein said toner is negative toner and said respective triboelectric series have a relationship in which said toner base particle, said toner carrier member and said surface additives are arranged in this order from the plus side.

16. The developing method according to claim 15, wherein the amount of said surface additives is not smaller than 0.5 wt %.

17. The developing method according to claim 15, wherein said surface additive is made of fine particles treated with hexamethyldisilazane.

18. The developing method according to claim 15, wherein said toner carrier member has a surface made of a fluorine compound.

19. The developing method according to claim 15, wherein a triboelectric series of a supply member is arranged on the plus side with respect to the triboelectric series of said toner base particle,

20. The developing method according to claim 15, wherein a triboelectric series of a toner layer (thickness) regulating member is arranged on the plus side with respect to the triboelectric series of said toner base particle.

21. A developing method of the type in which toner constituted by toner base particles and a surface additive is transferred to a latent image carrier by using a toner carrier member to make an electrostatic latent image on said latent image carrier visible, wherein the improvement comprises using a respective triboelectric series of said toner carrier, said toner base particle and said surface additives having a predetermined relationship in an order defined from a plus or minus side, wherein said toner is positive toner and said respective triboelectric series have a relationship in which said toner carrier member, said surface additives and said toner base particle are arranged in this order from the minus side.

22. The developing method according to claim 21, wherein said surface additive is made of fine particles treated with aminosilane.

23. The developing method according to claim 21, wherein said toner carrier member is made of ethylene-propylene-diene rubber.

24. The developing method according to claim 21, wherein said toner carrier member is made of silicon.

25. The developing method according to claim 21, wherein a triboelectric series of a supply member is arranged on the minus side with respect to the triboelectric series of said surface additives.

26. The developing method according to claim 21, wherein a triboelectric series of a toner layer (thickness) regulating member is arranged on the minus side with respect to the triboelectric series Of said surface additives.

27. The developing method of claim 1, wherein said toner is positive toner and said respective triboelectric series have a relationship in which said toner carrier member, said toner base particle and said surface additives are arranged in this order from the minus side.

28. The developing method according to claim 27, wherein said surface additive is made of fine particles of aluminum oxide.

29. The developing method according to claim 27, wherein said surface additive is made of fine particles of titanium oxide.

30. The developing method according to any one of claims 27, 28 and 29, wherein said surface additive is made of fine particles treated with aminosilane and octylsilane.

31. The developing method according to claim 27, wherein said toner carrier member has a surface made of a fluorine compound.

32. The developing method according to claim 27, wherein a triboelectric series of a supply member is arranged on the minus side with respect to the triboelectric series of said toner base particle.

33. The developing method according to claim 27, wherein a triboelectric series of a toner layer (thickness) regulating member is arranged on the minus side with respect to the triboelectric series of said toner base particle.

34. The developing method of claim 1, wherein said toner is positive tone and said respective triboelectric series have a relationship in which said base particle, said toner carrier member and said surface additives are arranged in this order from the minus side.

35. The developing method according to claim 34, wherein the amount of said surface additives is not smaller than 0.5 wt %.

36. The developing method according to claim 34, wherein said surface additive is made of fine particles of aluminum oxide.

37. The developing method according to claim 34, wherein said surface additive is made of fine particles treated with aminosilane and octylsilane.

38. The developing method according to claim 34, wherein said toner carrier member has a surface made of Nylon.

39. The developing method according to claim 34, wherein a triboelectric series of a supply member is arranged on the minus side with respect to the triboelectric series of said toner base particle.

40. The developing method according to claim 34, wherein a triboelectric series of a toner layer (thickness) regulating member is arranged on the minus side with respect to the triboelectric series of said toner base particle.

41. The developing method according to claim 9, wherein positive charging of said toner based particles is reduced.

42. The developing method according to claim 9, wherein the deposit of said surface additives on said toner carrier member is substantially reduced.

43. The developing method according to claim 15, wherein positive charging of said toner based particles is reduced.

44. The developing method according to claim 15, wherein the rate of covering of said toner carrier member with surface additives is increased.

45. The developing method according to claim 15, wherein the surface additives are contained in the surface of said toner based particles.

46. The developing method according to claim 27, wherein negative charging of said toner based particles is reduced.

47. The developing method according to claim 27, wherein the deposit of said surface additive on said toner carrier member is substantially reduced.

48. The developing method according to claim 34, wherein negative charging of said toner based particles is reduced.

49. The developing method according to claim 34, wherein the rate of covering the surface of said toner carrier member with surface additives is increased.

50. The developing method according to claim 34, wherein the surface additives are contained in the surface of said toner base particles.

* * * * *